US007240989B2

(12) United States Patent
Tomita et al.

(10) Patent No.: US 7,240,989 B2
(45) Date of Patent: Jul. 10, 2007

(54) LIQUID DELIVERY HEAD, LIQUID DELIVERY DEVICE, AND LIQUID DELIVERY HEAD DRIVING METHOD

(75) Inventors: Manabu Tomita, Kanagawa (JP); Iwao Ushinohama, Kanagawa (JP); Takeo Eguchi, Kanagawa (JP); Fusa Nakayama, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/512,755

(22) PCT Filed: Feb. 25, 2004

(86) PCT No.: PCT/JP2004/002221

§ 371 (c)(1),
(2), (4) Date: May 16, 2005

(87) PCT Pub. No.: WO2004/076188

PCT Pub. Date: Sep. 10, 2004

(65) Prior Publication Data

US 2005/0225582 A1 Oct. 13, 2005

(30) Foreign Application Priority Data

Feb. 28, 2003 (JP) ..... 2003-052213

(51) Int. Cl.
*B41J 2/14* (2006.01)

(52) U.S. Cl. ..... 347/48

(58) Field of Classification Search ..... 347/48–68, 347/12, 57–59, 5–6
See application file for complete search history.

(56) References Cited

U.S. PATENT DOCUMENTS 6,749,286 B2 * 6/2004 Eguchi ..... 347/48
6,817,704 B2 * 11/2004 Eguchi et al. ..... 347/60
2002/0126181 A1 * 9/2002 Miyamoto et al. ..... 347/63
2002/0145645 A1 * 10/2002 Aono et al. ..... 347/48
2002/0175973 A1 * 11/2002 Moon et al. ..... 347/47

FOREIGN PATENT DOCUMENTS

| | | |
|---|---|---|
| EP | 0 816 084 | 1/1998 |
| EP | 1 000 745 | 5/2000 |
| JP | 08-48034 | 2/1996 |
| JP | 08048034 A * | 2/1996 |
| JP | 2000-127399 | 5/2000 |

* cited by examiner

*Primary Examiner*—Stephen Meier
*Assistant Examiner*—Jason Uhlenhake
(74) *Attorney, Agent, or Firm*—Sonnenschein Nath & Rosenthal LLP

(57) ABSTRACT

The present invention is applied to a printer that discharges ink drops by driving, for example, heater elements. In the case where a plurality of variable pressure generator elements are driven to control the direction in which the drop is discharged, the present invention makes it possible to lay out drive circuits and so on efficiently so as to arrange nozzles in a high density. According to the present invention, in the case where a plurality of variable pressure generator elements 15A and 15B are provided for a liquid chamber, and are controlled to control the direction in which the drop is discharged, a sub-control circuit 31 varies the balance between the variable pressure generator elements 15A and 15B driven by a main control circuit 27. Since the current concerning the sub-control circuit 31 is small, the wiring pattern concerning the sub-control circuit 31 is formed in a narrow width.

15 Claims, 8 Drawing Sheets

LIQUID DELIVERY HEAD, LIQUID DELIVERY DEVICE, AND LIQUID DELIVERY HEAD DRIVING METHOD

BACKGROUND OF INVENTION

The present invention relates to a liquid discharging head which discharges liquid in a liquid chamber from a nozzle using energy such as thermal energy, a liquid discharging apparatus having the liquid discharging head, and a driving method for the liquid discharging head.

Recently, in the fields of hard copy, printing, and so on, the need for color output has increased. In response to this need, apparatuses have been proposed such as image producing apparatuses and liquid discharging apparatuses using color image production methods such as a thermal dye sublimation method; a thermal wax transfer method; an ink-jet method; an electro-photographic method; and a thermal silver-salt development method.

A liquid discharging apparatus using the ink-jet method discharges a drop of recording liquid (ink) from a nozzle of a printer head, which is a liquid discharging head, onto a recording medium to form a dot. The apparatus has a simple structure and can produce a high quality image. In this ink-jet method, an energy generating element applies energy to the ink in a liquid chamber, thereby causing an ink drop to be discharged from the nozzle. The ink-jet methods are classified according to the kind of energy generating element into an electrostatic attraction type; a continuous-vibration generating type (piezo type); and a thermal type.

In the thermal type, a heater element is used as the energy generating element. Local heating (application of energy) of the ink in the liquid chamber by the heater element generates bubbles in the ink in the liquid chamber. The pressure generated in the bubbles causes the ink to be discharged from the nozzle onto the recording medium. An apparatus using the thermal-type ink-jet method has a simple structure and can print a color image.

A liquid discharging head used in a liquid discharging apparatus using the thermal-type ink-jet method is manufactured by providing a semiconductor substrate with drive circuits, which are logic ICs, driving heater elements; heater elements; ink chambers; and nozzles, in this order, as disclosed in Japanese Unexamined Patent Application Publication No. 7-68759. Since the heater elements are integrated with the drive circuits, the heater elements can be arranged at a high density. Therefore, high-resolution prints can be obtained.

In most of such liquid discharging heads, a head chip having the following structure is used. That is to say, each nozzle is provided with a heater element; the heater elements are aligned in a row on the substrate; on one side of the row, the drive circuits are provided; and on the other side thereof, an ink flow path is provided. By using such a head chip, the liquid discharging head can be miniaturized.

Concerning such a liquid discharging head, as disclosed in Japanese Unexamined Patent Application Publication No. 8-48034, a method for controlling the discharging direction of the liquid drop is proposed. In the method, the discharging direction of the liquid drop is controlled by separately driving a plurality of energy-generating elements provided for each liquid chamber.

FIG. 1 shows the liquid discharging head viewed from the side where the nozzles are provided. In FIG. 1, a nozzle 1 is provided for each ink chamber 2. For each ink chamber 2, two heater elements 3A and 3B are provided side by side in the direction in which the ink chambers 2 are aligned. As shown in FIG. 2, one end of each of the heater elements 3A and 3B is connected to a common wiring pattern 4. The heater elements 3A and 3B are connected to a power supply 5 via the common wiring pattern 4. The other ends of each of the heater elements 3A and 3B are respectively connected to transistors 7A and 7B via wiring patterns 6A and 6B, respectively. The heater elements 3A and 3B are grounded via the transistors 7A and 7B, respectively. The transistors 7A and 7B are separately switched on at a predetermined timing according to the timing-control of a control circuit 9 to drive the heater elements 3A and 3B, respectively. The currents IA and IB flowing through the heater elements 3A and 3B, respectively, are controlled based on the determination of gate-voltage in the on-state by the control circuit 9. The heater elements 3A and 3B have about the same shapes and about the same resistance values. The heater elements 3A and 3B are arranged about symmetrically with respect to the center line of the nozzle 1. The liquid chamber 2 is about symmetrical with respect to the middle line between the heater elements 3A and 3B.

When either heater element 3A or 3B is driven, an ink drop is discharged at an angle.

Concerning the above-described structure, in the case where each nozzle 1 is provided with two heater elements 3A and 3B, where the heater elements 3A and 3B are aligned in a row, where the drive circuits are provided on one side of the row, and where an ink flow path is provided on the other side thereof, however, the wiring pattern 4 or the wiring patterns 6A and 6B connected to the heater elements 3A and 3B need to be bent. In this case, as shown in FIG. 1, a drive circuit composed of the transistors 7A and 7B and the control circuit 9 are provided on the side of the wiring patterns 6A and 6B connecting the heater elements 3A and 3B to the transistors 7A and 7B, respectively. The common wiring pattern 4 is bent and led to the side of the wiring patterns 6A and 6B through the gap between the adjacent heater-element pairs. In this way, the drive circuit and the wiring patterns 4, 6A, and 6B can be laid out efficiently.

The current IA or IB flowing through the individual wiring pattern 6A or 6B, respectively, flows through the common wiring pattern 4. When the transistors 7A and 7B are both driven to drive both of the heater elements 3A and 3B, the current IA+IB flows through the common wiring pattern 4. Therefore, in the conventional structure, the width of this common wiring pattern 4 needs to be greater than or equal to the sum of the width of the individual wiring pattern 6A and the width of the individual wiring pattern 6B. This causes problems in that the nozzles cannot be arranged at a high density. Incidentally, in the conventional structure, if the width of the common wiring pattern 4 is less than the sum of the width of the individual wiring pattern 6A and the width of the individual wiring pattern 6B, wire breakage occurs due to electromigration.

SUMMARY OF THE INVENTION

Considering the above, it is an object of the present invention to provide a liquid discharging head, a liquid discharging apparatus, and a driving method for the liquid discharging head capable of laying out drive circuits and so on efficiently so as to arrange nozzles in a high density, in the case where a plurality of energy generating elements are driven to control the direction in which the drop is discharged.

To attain this object, the present invention is a liquid discharging head or a liquid discharging apparatus including: at least one liquid chamber holding liquid; a nozzle provided for each liquid chamber; at least one pair of energy generating elements provided for each liquid chamber, and applying energy to the liquid held in the liquid chamber to discharge the liquid from the nozzle; a main control circuit connecting a series circuit of the at least one pair of energy generating elements to a power supply, and driving the at least one pair of energy generating elements according to the timing for discharging the liquid; a sub-control circuit connected to a connection midpoint between the at least one pair of energy generating elements, and varying the balance of energy generation between the at least one pair of energy generating elements; a first wiring pattern connecting the connection midpoint to the sub-control circuit; and second wiring patterns connecting the at least one pair of energy generating elements to the main control circuit, wherein the first wiring pattern has a width narrower than the width of the second wiring pattern.

According to the present invention, when the at least one pair of energy generating elements are driven, the driving by the sub-control circuit needs a small current compared with the driving by the main control circuit which needs a large current. Therefore, the first wiring pattern can be formed in a narrow width compared with the second wiring patterns. In the case where a plurality of energy generating elements are driven to control the direction in which the drop is discharged, drive circuits and so on can be laid out efficiently so as to arrange the nozzles in a high density.

In addition, the present invention is a driving method for a liquid discharging head including a liquid chamber holding liquid; a nozzle provided for the liquid chamber; at least one pair of energy generating elements provided for the liquid chamber, and applying energy to the liquid held in the liquid chamber to discharge the liquid from the nozzle; a main control circuit connecting a series circuit of the at least one pair of energy generating elements to a power supply; a sub-control circuit connected to a connection midpoint between the at least one pair of energy generating elements; a first wiring pattern connecting the connection midpoint to the sub-control circuit; and second wiring patterns connecting the at least one pair of energy generating elements to the main control circuit, the driving method including the steps of: driving the series circuit of the at least one pair of energy generating elements according to the timing for discharging the liquid by the main control circuit; and varying the balance of energy generation between the at least one pair of energy generating elements by the sub-control circuit. The first wiring pattern has a width narrower than the width of the second wiring pattern because the current necessary for the sub-control circuit is smaller than the current necessary for the main control circuit.

In the case where a plurality of energy generating elements are driven to control the direction in which the drop is discharged, drive circuits and so on can be laid out efficiently so as to arrange the nozzles in a high density.

DETAILED DESCRIPTION OF THE PRESENTLY PREFERRED EMBODIMENTS

The embodiments of the present invention will now be described with reference to the drawings.

(1) Structure of Embodiment

Figure 3:
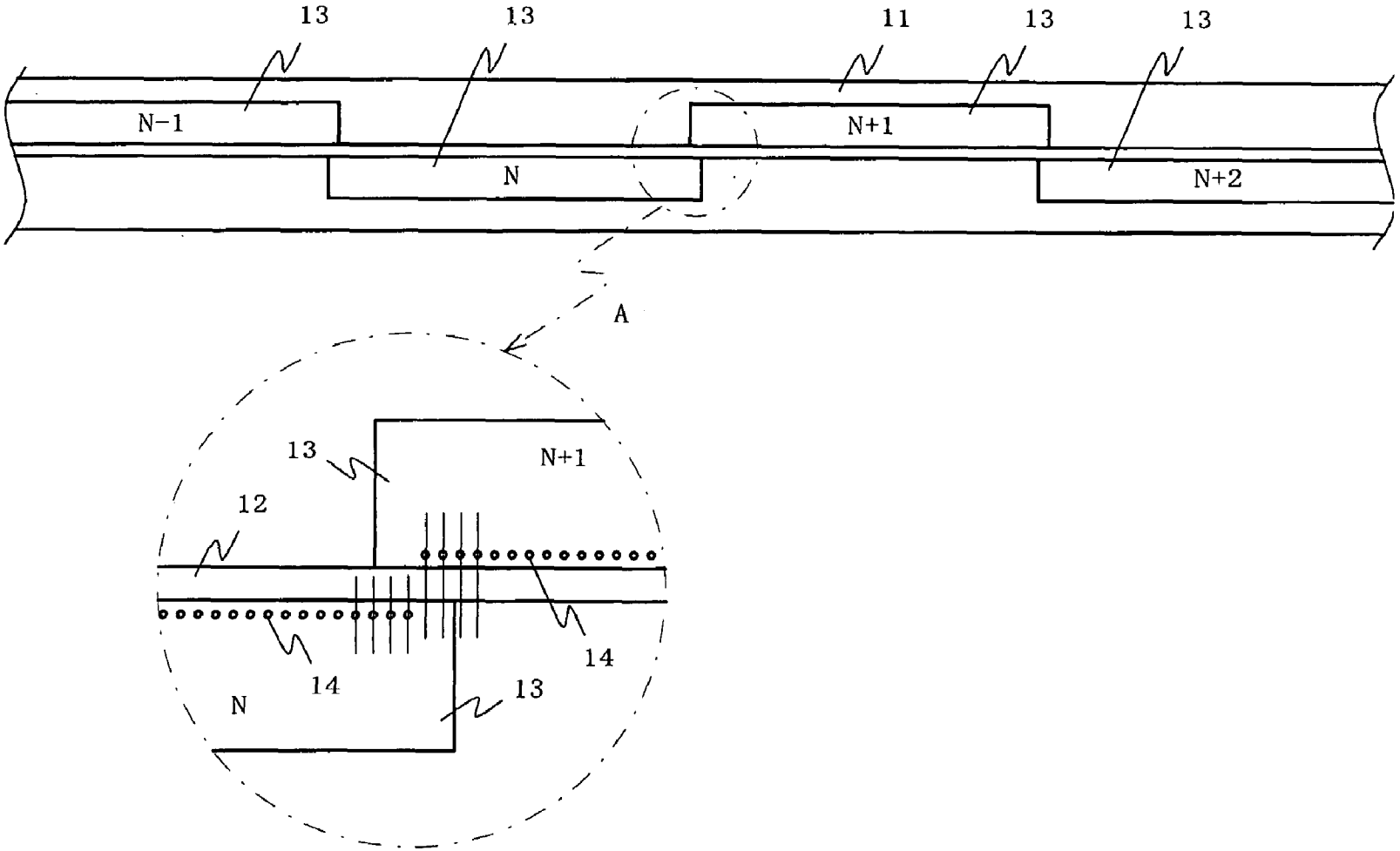
FIG. 3 is a plan view showing part of a printer head according to an embodiment of the present invention.

FIG. 3 is a plan view showing a printer head used in a printer according to this embodiment. This printer head 11 is a line head. An ink flow path 12 connected to an ink tank is formed of a predetermined member so as to extend across the width of paper as an object of printing. On either side of the ink flow path 12, head chips 13 are staggered. Each head chip 13 has a row of ink discharging mechanisms.

The head chip 13 is formed in a rectangular-solid shape. Along its longitudinal face, nozzles 14 are formed at a fixed nozzle pitch. The ink supplied from the ink flow path 12 is discharged from the nozzles 14. In such a staggered arrangement, the head chips 13 are arranged so that the nozzles 14 are arranged at a fixed nozzle pitch in the alignment direction of the nozzles 14, even between the head chips 13 adjacent to each other. The printer head 11 can print a desired image by driving the head chips 13 arranged across the width of the paper.

If the nozzles 14 are arranged at a high density, the nozzle pitch is narrower. Therefore, due to an error in fitting of the head chips 13, variation in the nozzle pitch becomes large at the joint between the head chips 13 adjacent to each other. In this embodiment, controlling the direction in which the ink drop is discharged from the head chip 13 makes it possible to compensate for the variation in the nozzle pitch between the head chips 13 adjacent to each other.

Figure 4:
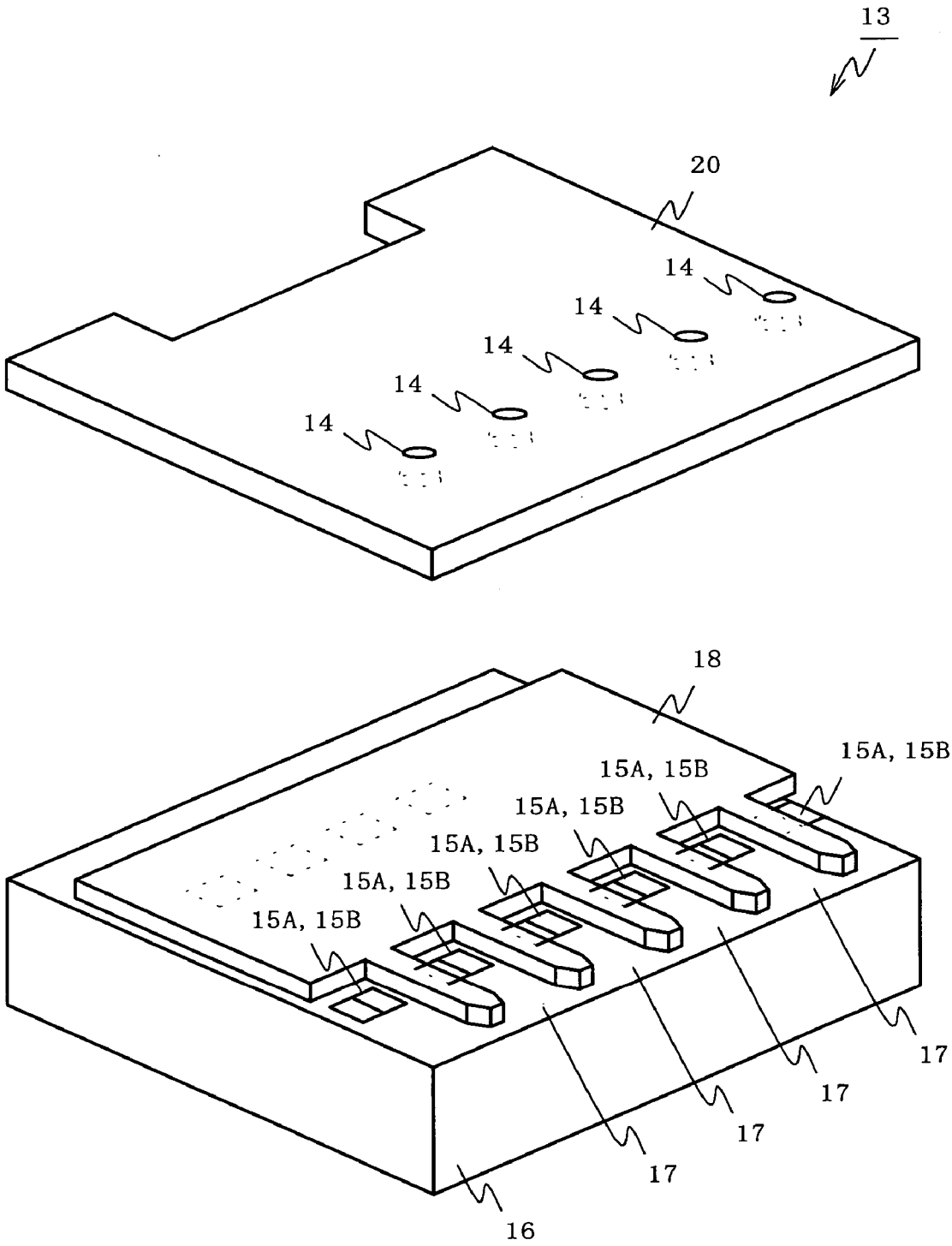
FIG. 4 is an exploded perspective view showing a head chip of the printer head in FIG. 3.
Figure 5:
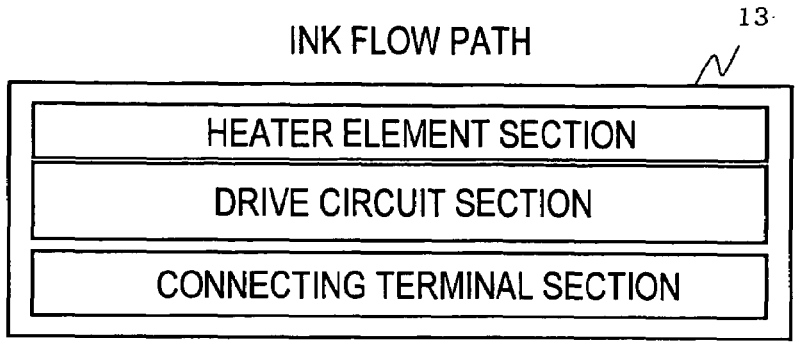
FIG. 5 is a plan view showing the structure of the printer head.

As shown in FIG. 4, the head chip 13 is manufactured by providing a semiconductor substrate 16 with a separating wall 18 so as to form ink chambers 17, and thereafter providing a nozzle plate 20. On the semiconductor substrate 16, drive circuits driving heater elements 15A and 15B are provided. In the nozzle plate 20, the nozzles 14 are formed. In the head chip 13, as shown in FIG. 5, the heater elements 15A and 15B are aligned along the longitudinal face facing the ink flow path 12. In the region along this face, a heater element section is thus formed. In addition, from this heater element section to the opposite face, a drive circuit section and a connecting terminal section are provided in this order. In the drive circuit section, drive circuits driving the heater elements 15A and 15B are arranged. In the connecting terminal section, connecting terminals connecting the driver circuits to a power supply and so on are arranged.

The ink in the ink flow path 12 is led to the ink chambers 17 from the face adjacent to the heater elements 15A and 15B. The drive circuits are provided across the row of the heater elements 15A and 15B from the ink flow path 12.

Thus, in the head chip 13, the heater elements 15A and 15B, the drive circuits, and so on are laid out efficiently. The head chips 13 are manufactured efficiently by providing or forming the drive circuits, the heater elements, and the ink chambers for a plurality of chips on a semiconductor wafer, thereafter cutting the semiconductor wafer into a plurality of chips, and then attaching a nozzle plate 20 to each chip.

Figure 6:
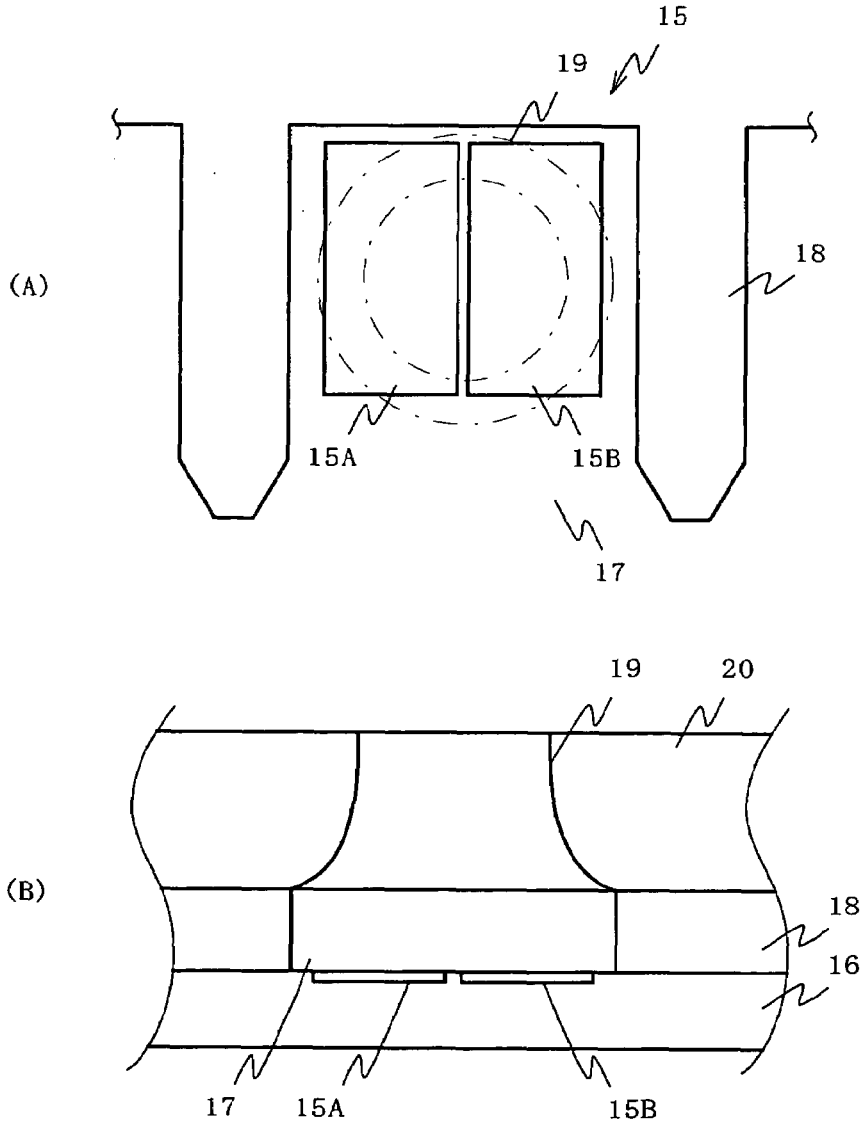
FIGS. 6(A) and 6(B) are a plan view and a sectional view, respectively, showing an ink chamber.

As shown in FIG. 6(A), a plan view, and FIG. 6(B), a sectional view, each liquid chamber 17 is provided with a pair of heater elements 15A and 15B. The pair of heater elements 15A and 15B have about the same shapes and about the same resistance values, and are arranged side by side in the direction in which the liquid chambers 17 are aligned. FIG. 6(A) is a plan view with the nozzle plate 20 removed. The printer head 11 can control the direction in which the ink drop is discharged by controlling the driving of the heater elements 15A and 15B, which are energy generating elements applying energy to the ink in the ink chamber 17.

Figure 7:
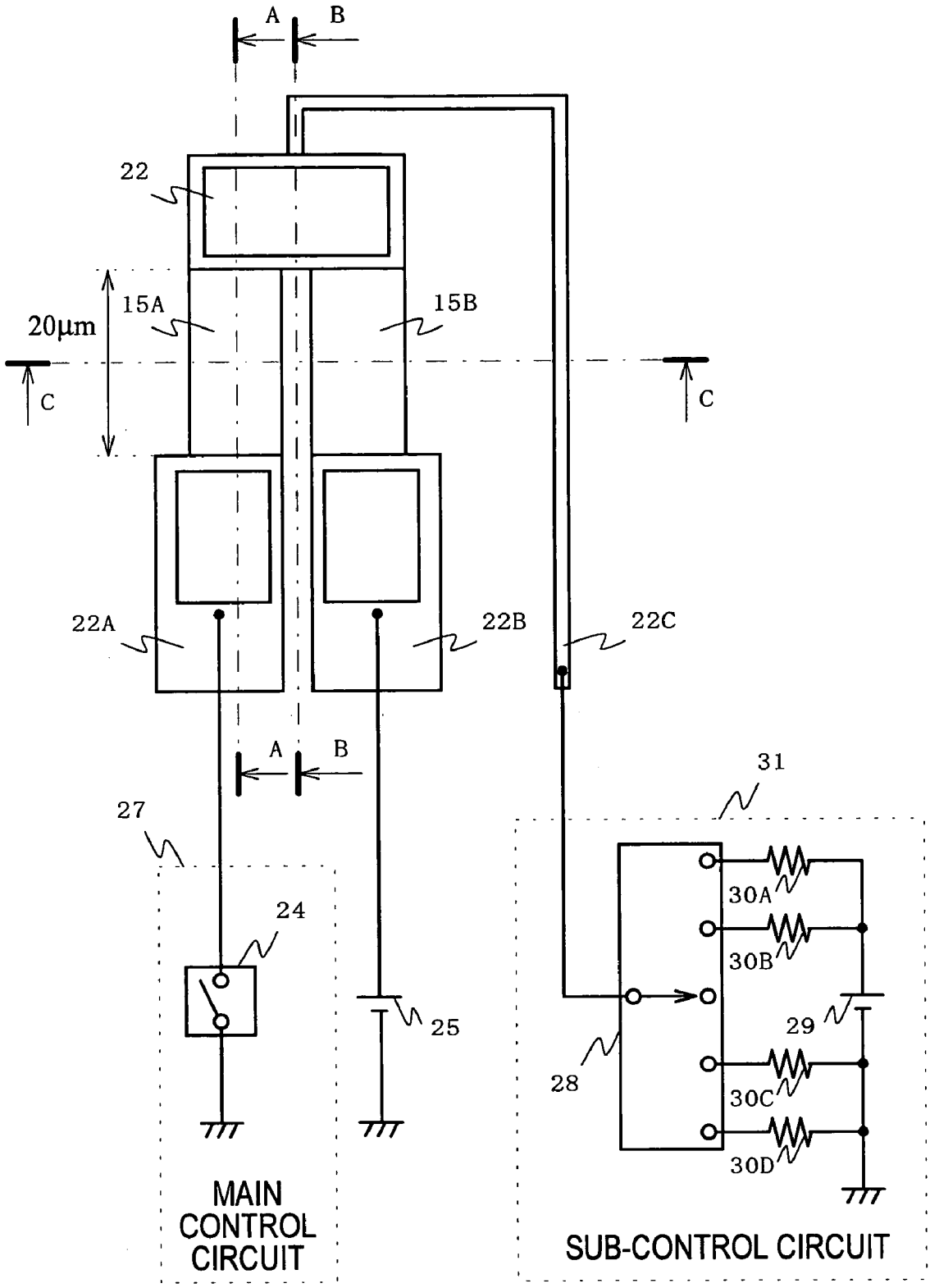
FIG. 7 is a schematic diagram explaining the drive control in the printer head of FIG. 3.

FIG. 7 is a connection diagram explaining the principle of controlling the driving of the heater elements 15A and 15B. In the head chip 13, on the side of the ink flow path 12, the heater elements 15A and 15B are connected by a wiring pattern 22, and thereby a series circuit of the heater elements 15A and 15B is formed. In addition, on the opposite side of the heater elements 15A and 15B from the ink flow path 12, the heater elements 15A and 15B are connected to wiring patterns 22A and 22B, respectively. The wiring patterns 22A and 22B are connected to the main control circuit 27. The main control circuit 27 is a drive circuit driving the series circuit of the heater elements 15A and 15B in the timing for discharging the ink drop. The main control circuit 27 connects the series circuit of the heater elements 15A and 15B to the power supply 25 via a switching circuit 24.

Moreover, in the head chip 13, the connection midpoint between the heater elements 15A and 15B connected by the wiring pattern 22 is connected to the sub-control circuit 31. According to the direction in which the ink drop is discharged, the sub-control circuit 31 varies the currents applied by the main control circuit 27 to the heater elements 15A and 15B. That is to say, according to the direction in which the ink drop is discharged, the sub-control circuit 31 switches contacts of a selector 28 which is connected to the wiring pattern 22, thereby varying the balance between the energies generated by the heater elements 15A and 15B. Such a balance control can be performed by switching between inflow and outflow of the current into and out of the connection midpoint between the heater elements 15A and 15B, and by varying the value of inflow or outflow of current. This can also be performed by varying the electric potential of the connection midpoint. In FIG. 7, such a mechanism to vary the electric potential or the current is composed of the selector 28, a power supply 29, and resistors 30A to 30D. That is to say, when the resistor 30A or 30B connected to the power supply 29 is selected, the selector 28 allows the current to flow into the connection midpoint between the heater elements 15A and 15B. The current is determined by the resistance values of the heater elements 15A and 15B, the resistance value of the resistor 30A or 30B, and the voltage of the power supply 29. When the contact to which nothing is connected is selected, the selector 28 stops varying the balance between the energies generated by the heater elements 15A and 15B. When the grounded resistor 30C or 30D is selected, the selector 28 allows the current to flow out of the connection midpoint between the heater elements 15A and 15B. The current is determined by the resistance values of the heater elements 15A and 15B and the resistance value of the resistor 30C or 30D.

Compared with the driving by the main control circuit 27, which needs a large current, the driving by the sub-control circuit 31 only needs a small current. Therefore, a wiring pattern 22C connecting the heater elements 15A and 15B to the sub-control circuit 31 can be narrow compared with the wiring pattern 22A or 22B provided for the heater elements 15A or 15B, respectively.

Figure 1:
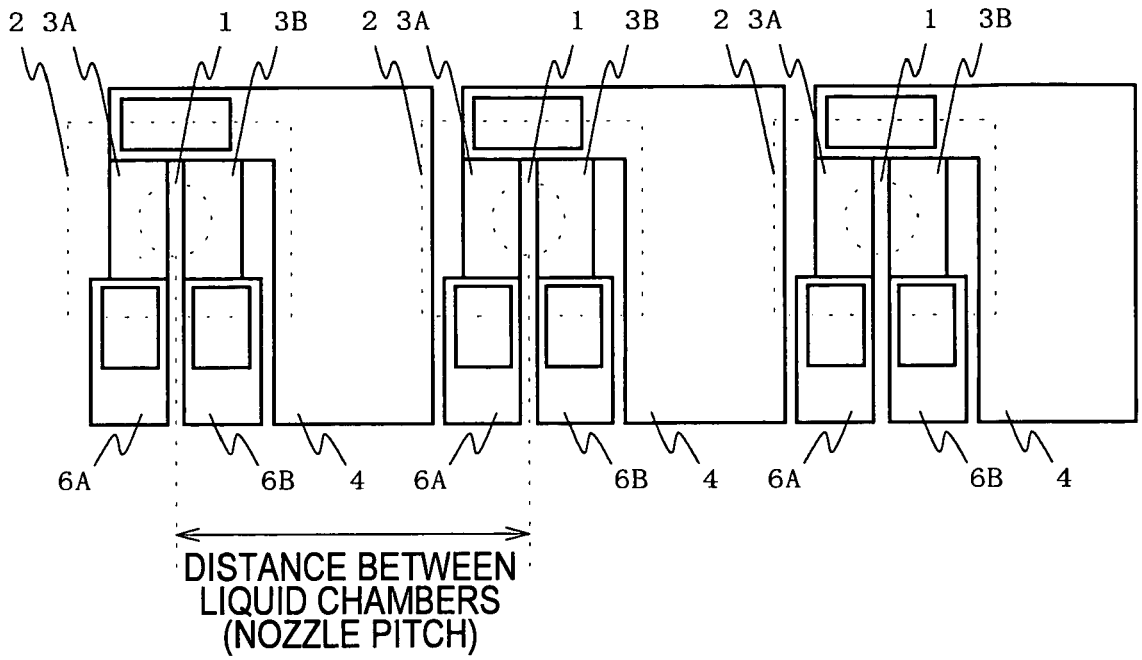
FIG. 1 is a plan view showing a layout when a plurality of heater elements are arranged.
Figure 2:
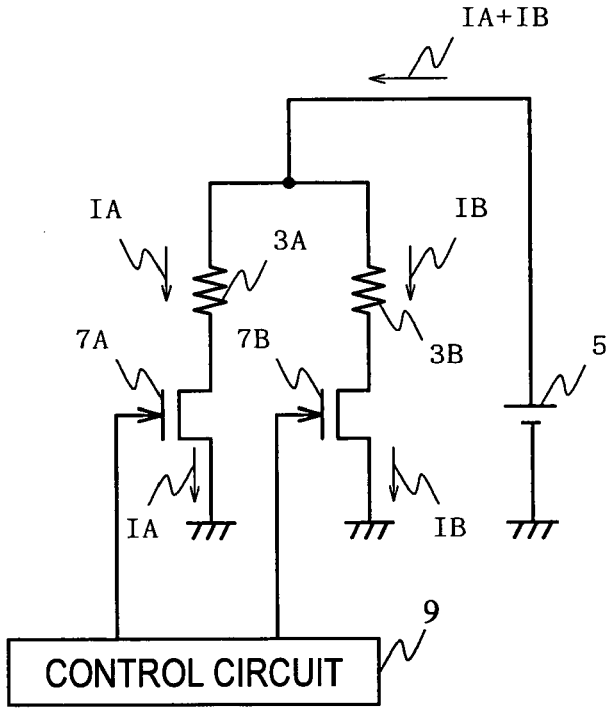
FIG. 2 is a connection diagram in the case where the heater elements according to the structure in FIG. 1 are driven separately.

In the case of the structure described above with reference to FIG. 1, when the resistance values of the heater elements 3A and 3B are 50 [Ω] each, and when the heater elements 3A and 3B are driven by an electric power of 0.5 [W] each, a current of 0.2 [A] flows through the common wiring pattern 4. In this case, when the common wiring pattern 4 has a thickness of 600 [nm], and when the wiring pattern 4 has a width of 15 [μm] for a current of 0.1 [A] for sake of safety, the wiring pattern 4 needs a width of 30 [μm]. In addition, the wiring patterns 6A and 6B each need a width of 15 [μm]. Therefore, the nozzle pitch is 60 [μm] even when no gap is provided between the wiring patterns. In fact, since a gap is provided, the nozzle pitch is much wider. The nozzle pitch cannot be less than or equal to 65 [μm].

On the other hand, according to the structure shown in FIG. 7, when the heater elements 15A and 15B are each driven by an electric power of 0.5 [W], no current flows through the wiring pattern 22C connected to the sub-control circuit 31. In addition, when the heating values of the heater elements 15A and 15B are different, the direction in which the ink drop is discharged can be sufficiently angled by causing the drive currents of the heater elements 15A and 15B to differ by about ten percent. Therefore, the width of the wiring pattern 22C needs to be only a tenth part of that of the wiring pattern 22A or 22B. For example, when the heater elements 15A and 15B are driven by electric powers of 0.5 [W] and 0.4 [W], respectively, the current flowing through the wiring patterns 22A and 22B and the current flowing through the wiring pattern 22C are 0.1 [A] and 0.089 [A], respectively.

Figure 8:
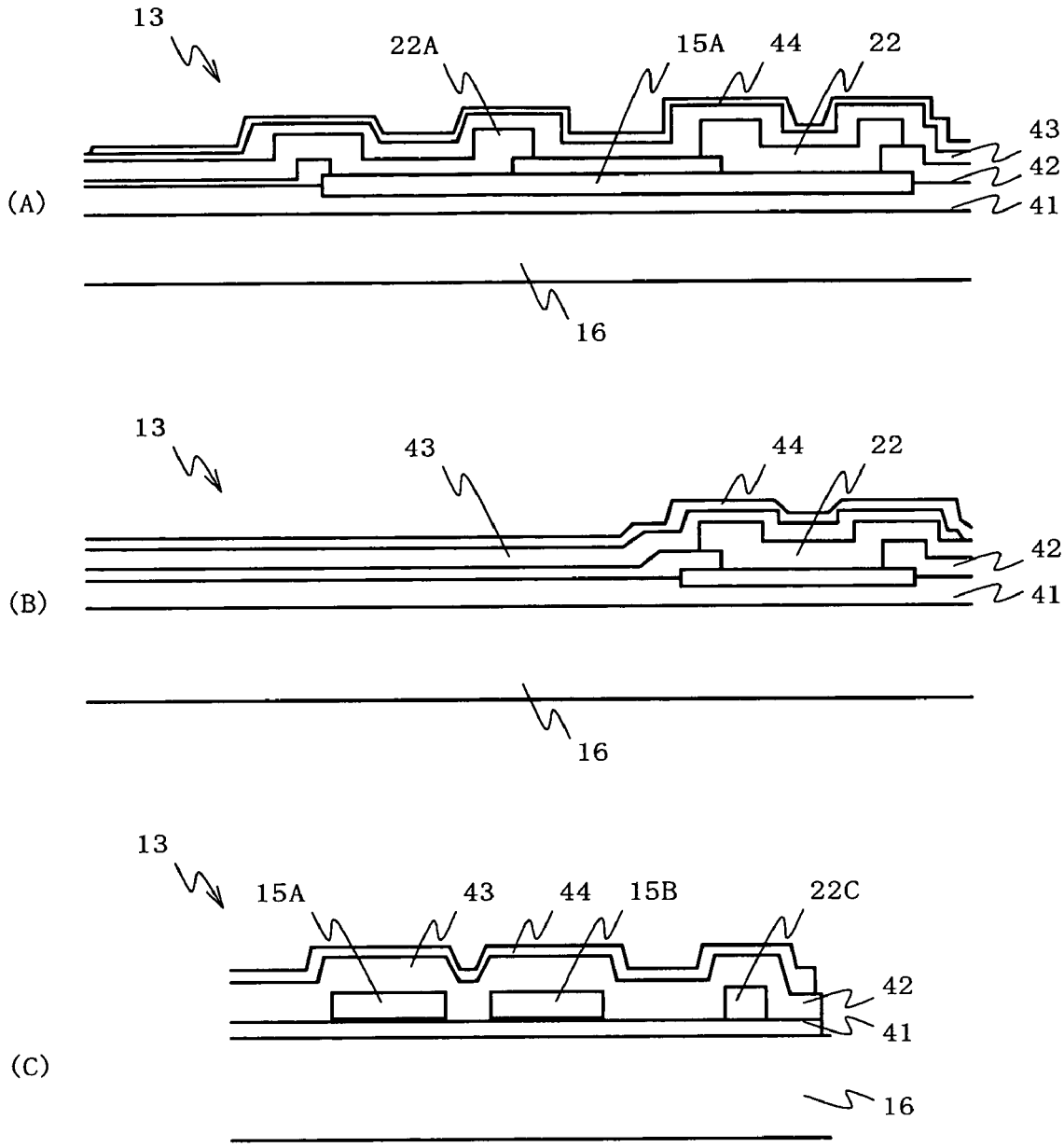
FIGS. 8(A), 8(B), and 8(C) are sectional views taken along lines A-A, B-B, and C-C, respectively, in FIG. 7(A).

FIGS. 8(A), 8(B), and 8(C) are sectional views taken along lines A-A, B-B, and C-C, respectively, of FIG. 7. In the head chip 13, the width of the wiring pattern 22C is about a tenth part of that of the wiring pattern 22A or 22B. In addition, the wiring pattern 22C is disposed in the same layer as the wiring patterns 22A and 22B, and in the gap between the shown heater element 15B and the heater element 15A (not shown) provided for the adjacent ink chamber 17. Thus, sufficient space is obtained in the head chip 13, so that the nozzle pitch of the head chip 13 is 42.3 [nm]. In FIG. 7, the reference numerals 41, 42, and 43 denote interlayer insulating films of silicon nitride, and the reference numeral 44 denotes a cavitation-resistant layer of a tantalum film.

In this embodiment, the head chip 13 is made by forming a tantalum film with a thickness of 80 [nm] by sputtering, and thereafter forming the heater elements 15A and 15B with predetermined shapes by lithography and etching. The heater elements 15A and 15B have a resistance value of 105 [Ω] each. In this embodiment, the heater elements 15A and 15B are driven by an electric power of 0.8 [W] to discharge the ink drop. The sub-control circuit 31 causes a current of up to ±0.01 [A] to flow through the wiring pattern 22C, thereby causing the heater elements 15A and 15B to differ in their operation.

Under this condition, in the case where the heater elements 15A and 15B are not caused to differ in their operation, a current of 0.087 [A] flows through each of the heater elements 15A and 15B. Therefore, the width of each of the wiring patterns 22A and 22B is set to 15 [μm]. The width of the wiring pattern 22C is set to 1.7 [μm] (15 [μm]×0.087 [A]/0.01 [A]).

Figure 9:
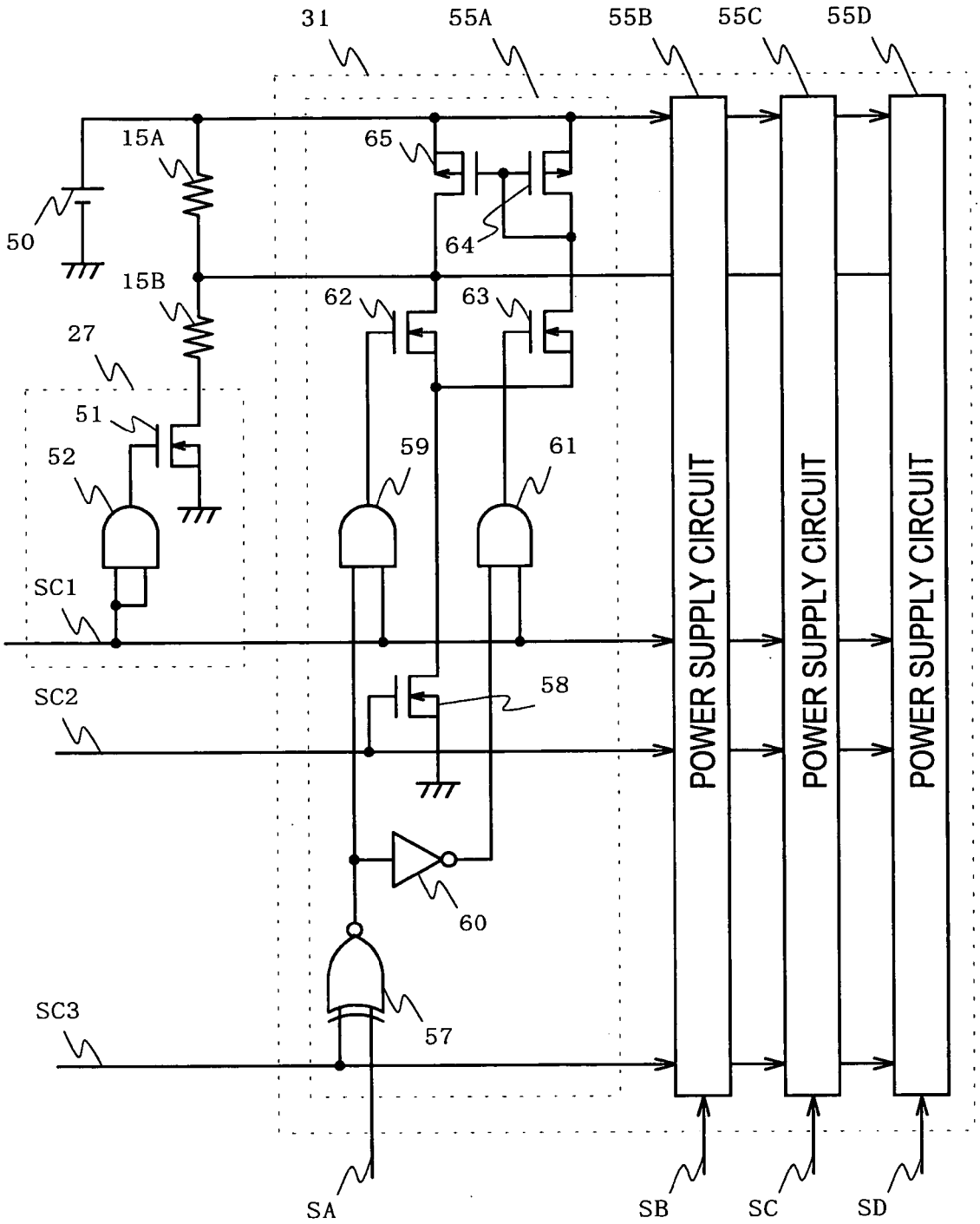
FIG. 9 is a connection diagram showing a main control circuit and a sub-control circuit.

FIG. 9 is a connection diagram showing specific structures of the main control circuit 27 and the sub-control circuit 31. The main control circuit 27 will be described. One end of the series circuit of the heater elements 15A and 15B is connected to the power supply 50, and the other end is grounded via a constant current circuit 51 which is a MOSFET. The operation of the constant current circuit 51 is controlled by a predetermined control signal SC1 via an AND circuit 52 which is an inverter circuit. The signal level of the control signal SC1 is raised by an image-data processing circuit (not shown) in timings when ink drops are discharged according to paper feed from the nozzle 14 to which the main control circuit 27 is allotted. In these timings, the series circuit of the heater elements 15A and 15B is driven by the power supply 50.

The sub-control circuit 31 is composed of power supply circuits 55A, 55B, 55C, and 55D which cause a predetermined value of current to flow into or out of the connection midpoint between the heater elements 15A and 15B. The proportion of values of the current caused to flow into or out of the connection midpoint by the power supply circuits 55A, 55B, 55C, and 55D is set to 4:2:1:1 based on a setting of a constant current circuit included in each power supply circuit. According to control signals SA, SB, SC, and SD, the power supply circuits 55A, 55B, 55C, and 55D, respectively, cause the heater elements 15A and 15B to differ in their operation based on the above values of current. Other than the above, the power supply circuits 55A, 55B, 55C, and 55D have the same structure. Therefore, the power supply circuits 55A alone will be described in detail.

In this embodiment, the proportion of current values of the power supply circuits 55A, 55B, 55C, and 55D is set to 4:2:2:1. Between the power supply circuits 55A, 55B, and 55C, the current value varies gradually in the manner of a factorial of two. Therefore, this embodiment as a whole has a simple structure, and the heater elements 15A and 15B are caused to differ in their operation efficiently.

In this embodiment, the control signals SA, SB, SC, and SD are determined so that the ink drops discharged from the nozzles 14 are in a predetermined pitch. This compensates for the variation in the position of the ink dot due to manufacturing variations such as an error in fitting of the head chips 13. Therefore, the quality of printing results is much higher than that of the conventional printer head.

A direction switching signal SC3 switches between the current inflow and the current outflow into and out of the connection midpoint between the heater elements 15A and 15B. In the power supply circuit 55A, the direction switching signal SC3 is input into an exclusive NOR circuit 57. According to the direction switching signal SC3, the exclusive NOR circuit 57 switches the polarity of the control signal SA. In the power supply circuit 55A, a signal output from this exclusive NOR circuit 57 is input directly into an AND circuit 59. The signal is also input into another AND circuit 61 via an inverter circuit 60, which reverses the polarity of the signal. The AND circuits 59 and 61 gate the output signal of the exclusive NOR circuit 57 and the output signal of the inverter circuit 60, respectively, according to the control signal SC1, and output them to the MOSFETs 62 and 63, respectively. While the heater elements 15A and 15B are driven according to the control signal SC1, the MOSFETs 62 and 63 are on/off-controlled complementarily according to the direction switching signal SC3 and the control signal SA.

In the power supply circuit 55A, the constant current circuit 58, which is a MOSFET, is on/off-controlled according to the control signal SC2 to cause the heater elements 15A and 15B to differ in their operation or not to cause. In the power supply circuits 55A to 55C, the proportion of values of current for causing the heater elements 15A and 15B to differ in their operation is set to 4:2:1:1 based on a setting of this constant current circuit 58.

The sources of the MOSFETs 62 and 63 are connected to this constant current circuit 58. The drain of the MOSFET 62 is connected to the connection midpoint between the heater elements 15A and 15B. The drain of the MOSFET 63 is connected to a current mirror circuit consisting of MOSFETs 64 and 65 provided on the power supply side. The MOSFET 65 of this current mirror circuit causes a constant current to flow into the connection midpoint between the heater elements 15A and 15B. This constant current has the same current value as that of the constant current circuit 58. While the heater elements 15A and 15B are driven according to the control signal SC1, the MOSFETs 62 and 63 are on/off-controlled complementarily according to the direction switching signal SC3 and the control signal SA. The constant current circuit 58, which is the standard of operation, operates according to the control signal SC2. In order to cause the heater elements 15A and 15B to differ in their operation, when the current flows out of the connection midpoint, the MOSFET 62 is switched on to allow the constant current circuit 58 to absorb the current. On the other hand, when the current flows into the connection midpoint, the MOSFET 63 is switched on to allow the constant current circuit 58 to discharge the current. In this way, the direction in which the ink drop is discharged from the nozzle 14 is controlled by the heater elements 15A and 15B.

Figure 10:
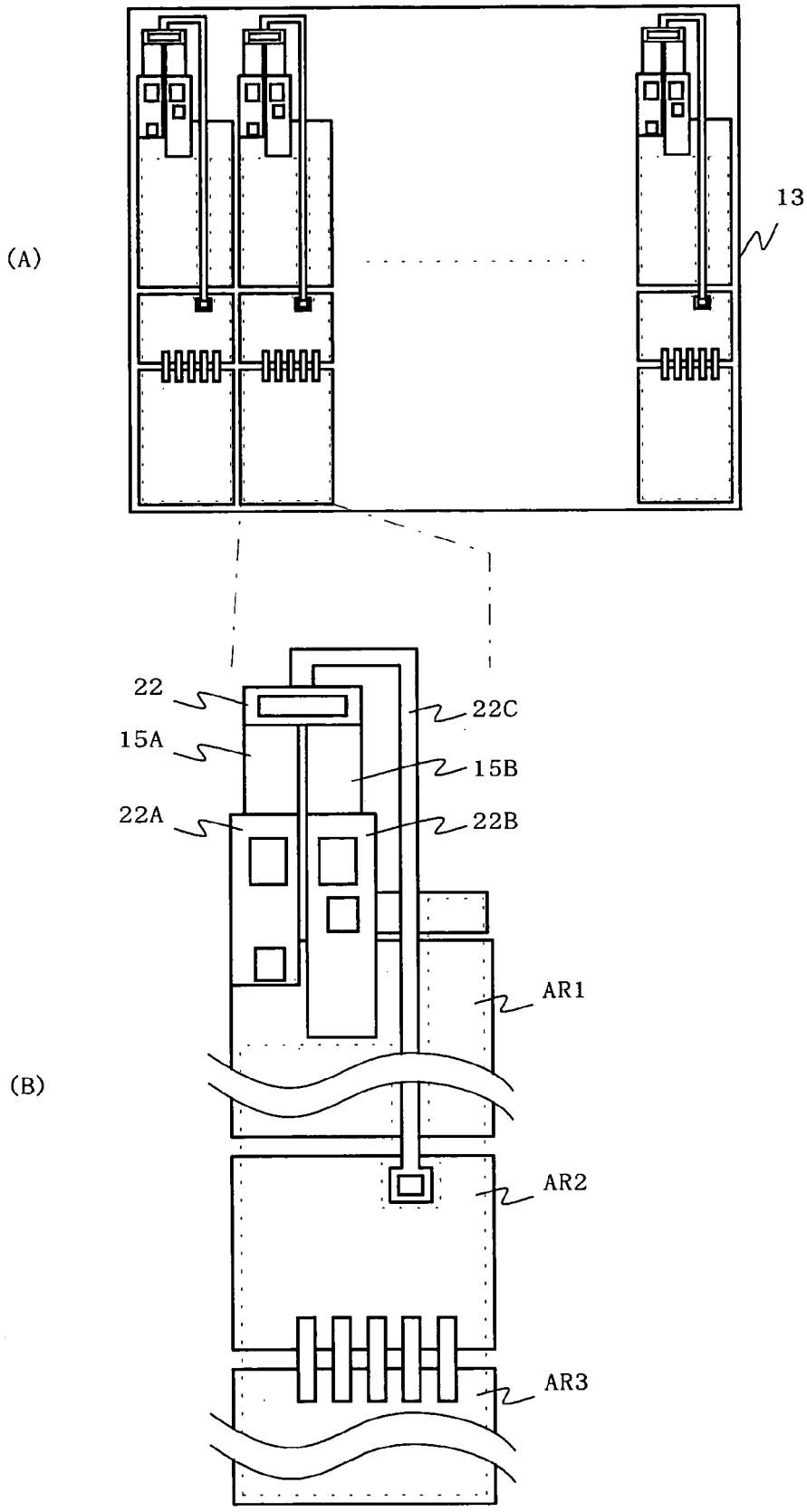
FIG. 10 is a plan view showing a specific layout of the head chip in FIG. 5.

FIG. 10 is a plan view showing a specific layout of the head chip having such a main control circuit 27 and a sub-control circuit 31. In the head chip 13, drive circuit units are arranged side by side in the longitudinal direction corresponding to the arrangement of the nozzles 14 (FIG. 10(A)). Each unit drives the heater elements 15A and 15B for each liquid chamber 17. In each unit, the wiring pattern 22, the wiring pattern 22C, the heater elements 15A and 15B, and the wiring pattern 22A and 22B are arranged in this order from the side of the ink flow path. The wiring pattern 22 connects the heater elements 15A and 15B in series. The wiring pattern 22C connects this wiring pattern 22 to the sub-control circuit 31. The wiring patterns 22A and 22B connect the heater elements 15A and 15B, respectively, to the main control circuit 27. In the adjacent region AR1, the MOSFET 51 of the main control circuit 27, and the MOSFETs 62 to 65 of the sub-control circuit 31 are disposed. In the next region AR2, the other components of the sub-control circuit 31 are disposed. In the further next region AR3, the other components of the main control circuit, and a control circuit controlling operation of the main control circuit and the sub-control circuit are disposed. In this way, the drive circuits for the heater elements 15A and 15B are disposed in the regions AR1 to AR3.

(2) Operation of Embodiment

In this printer having the above structure, based on image data, text data, and so on to print, ink drops are discharged from the printer head 11. The paper as an object of printing is conveyed by a paper feed mechanism. The ink drops adhere to the paper being conveyed. In this way, an image, a text, and so on are printed according to the operation of the printer head 11 (FIG. 7).

In the printer head 11 of the conventional printer, a plurality of head chips 13 are staggered. Each head chip 13 has ink discharging mechanisms. There is variation in the nozzle pitch due to variation in the arrangement of the head chips 13. In addition, there is variation in the characteristics of the head chip 13. Therefore, the position of the ink drop discharged from the nozzle 14 and adhering to the paper varies on a minute scale. This causes deterioration in the quality of print, and in an extreme case, vertical lines.

However, in the printer according to the present invention, the position where the ink drop adheres to the paper is corrected by tuning the direction in which the ink drop is discharged from the nozzle 14. In this way, deterioration in the quality of print is prevented efficiently. The ink drop is discharged by a so-called thermal type method by driving a plurality of heater elements 15A and 15B provided for each ink chamber 17. The plurality of heater elements are caused to differ in their operation. In this way, the direction in which the ink drop is discharged from the nozzle 14 is tuned (FIGS. 4 and 7).

In the printer of the present invention, the main control circuit 27 connects the series circuit of the heater elements 15A and 15B to the power supply 25 in a predetermined timing to drive and operate the heater elements 15A and 15B. At this time, the sub-control circuit 31 causes an inflow or an outflow of current into or out of the connection midpoint between the heater elements 15A and 15B to cause the heater elements 15A and 15B to differ in their operation. The current value of the inflow or the outflow is set to a tenth part at a maximum of the current concerning the main control circuit 27.

The width of the wiring pattern 22C can be set to about a tenth part of the width of the wiring pattern 22A or 22B. The wiring pattern 22C connects the sub-control circuit 31 and the connection midpoint between the heater elements 15A and 15B. The wiring patterns 22A and 22B connect the main control circuit 27 to the series circuit of the heater elements 15A and 15B. In the printer of the present invention, even when the wiring pattern 22C is bent toward the wiring patterns 22A and 22B and when the wiring pattern 22C is disposed in the same layer as the wiring patterns 22A and 22B, the nozzle pitch can be very small compared with the structure described above with reference to FIG. 1, and therefore a desired image can be printed at a high resolution.

In addition, the heater elements and the drive circuits can be laid out efficiently by arranging the nozzles at a small pitch, arranging the heater elements 15A and 15B side by side in the direction of the row of the nozzles 14, supplying ink from one side of the row of the nozzles, and disposing the main control circuits and the sub-control circuits on the other side of the row of the nozzles.

(3) Other Embodiments

Although the heater elements are made of a thin film of tantalum in the above embodiment, the present invention is not limited to this. The heater elements may be made of various resistor materials such as tungsten, nichrome, nickel, polysilicon, and titanium nitride.

Although the heater elements are driven or caused to differ in their operation by current drive in the above embodiment, the present invention is not limited to this. The heater elements may be driven or caused to differ in their operation by voltage drive.

Although two heater elements are provided for an ink chamber in the above embodiment, the present invention is not limited to this. Three or more heater elements may be provided. In this case, the plurality of heater elements are arranged side by side and connected in series. Each connection midpoint between the heater elements is connected to the sub-control circuit. The heater elements are caused to differ in their operation in the direction in which the heater elements are arranged side by side.

Although the heater elements are arranged side by side in the above embodiment, the present invention is not limited to this. The heater elements may be arranged in a radial pattern so that the ink drop is discharged in various directions. In this case, the number of heater elements is set to an even number. Each pair of heater elements disposed opposite each other is connected in series. Each connection midpoint between the pair of heater elements is connected to the sub-control circuit. Alternatively, all of the heater elements are connected in the center. The plurality of heater elements are driven by a phase feed method typified by a so-called Y-connection. The connection center is connected to the sub-control circuit. Alternatively, these may be combined.

Although the heater elements and the drive circuits are integrated on the semiconductor substrate in the above embodiment, the present invention is not limited to this. The heater elements and the drive circuits may be separated.

Although controlling the direction in which the ink drop is discharged is used for compensating for the variation in the position where the ink drop adheres on the paper in the above embodiment, the present invention is not limited to this. The controlling of the direction in which the ink drop is discharged may be used for increasing the quality of print, and for simplifying the structure, for example, in the case where a plurality of dots are formed by a single nozzle in order to increase resolution.

Although the present invention is applied to a thermal type line printer whose energy generating elements are heater elements in the above embodiment, the present invention is not limited to this. The present invention may be applied to printers or printer heads having other types of energy generating elements such as a piezo type and an electrostatic type.

Although the present invention is applied to a printer head discharging ink drops in the above embodiment, the present invention is not limited to this. The present invention may be applied to printer heads that discharge drops of various dyes, or drops of liquid for forming a protective layer, instead of ink drops. In addition, the present invention may be applied to micro dispensers, measuring apparatuses, and testing apparatuses that discharge drops of a reagent. Moreover, the present invention may be applied to pattern producing apparatuses that discharge drops of an agent protecting a member from etching.

INDUSTRIAL APPLICABILITY

As described above, when the direction in which the liquid drop is discharged is controlled by controlling operation of a plurality of heater elements which are energy generating elements provided for each liquid chamber, a main control circuit drives the heater elements, and a sub-control circuit varies the balance between the heater elements. Since the current concerning the sub-control circuit is small, the wiring pattern concerning the sub-control circuit can be formed in a narrow width. Therefore, when the direction in which the liquid drop is discharged is controlled by controlling operation of the plurality of energy generating elements, drive circuits and so on can be laid out efficiently to arrange nozzles in a high density.

That is to say, drive circuits and so on can be laid out efficiently to arrange nozzles in a high density by forming the wiring pattern concerning the sub-control circuit in a narrow width; arranging the heater elements side by side in a row in the direction in which the nozzles are aligned; providing the main control circuit and the sub-control circuit on one side of the row; providing an ink flow path on the other side thereof; and leading the wiring pattern concerning the sub-control circuit from the side of the flow path to the sub-control circuit via the gap between adjacent groups of the heater elements.

The invention claimed is:

1. A liquid discharging head comprising:

at least one liquid chamber holding liquid;

a nozzle provided for each liquid chamber;

at least one pair of energy generating elements provided for each liquid chamber, and applying energy to the liquid held in the liquid chamber to discharge the liquid from the nozzle;

a main control circuit connecting a series circuit of the at least one pair of energy generating elements to a power supply, and driving the at least one pair of energy generating elements according to the timing for discharging the liquid;

a sub-control circuit connected to a connection midpoint between the at least one pair of energy generating elements, and varying the balance of energy generation between the at least one pair of energy generating elements;

a first wiring pattern connecting the connection midpoint to the sub-control circuit; and second wiring patterns connecting the at least one pair of energy generating elements to the main control circuit, wherein, the first wiring pattern has a width narrower than the width of the second wiring pattern, and the sub-control circuit comprises a selector including a switch connected to the connection midpoint between the at least one pair of energy generating elements and selectively connectable to: (a) a first contact connected to a resistor and a power supply; (b) a second contact that is not connected to the power supply or to ground; and (c) a third contact connected to a resistor and ground, so that current flows from the sub-control circuit to the connection midpoint between the at least one pair of energy generating elements when the selector switch is connected to the first contact of said three contacts, current does not flow between the sub-control circuit and the connection midpoint between the at least one pair of energy generating elements when the selector switch is connected to the second contact of the three contacts, and current flows to the sub-control circuit from the connection midpoint between the at least one pair of energy generating elements when the selector switch is connected to the third contact of said three contacts is selected during operation of the liquid discharging head.

2. The liquid discharging head according to claim 1, wherein the energy generating element is a heater element.

3. The liquid discharging head according to claim 1, wherein the at least one liquid chamber are arranged in a row;

the at least one pair of energy generating elements are arranged in a row along the row of the liquid chambers;

the at least one pair of energy generating elements, the main control circuit, and the sub-control circuit are provided on a semiconductor substrate;

the main control circuit and the sub-control circuit are disposed on one side of the row of the energy generating elements, and a flow path supplying the liquid chambers with the liquid is disposed on the other side thereof;

the first wiring pattern is led from the side of the flow path to the sub-control circuit via the gap between adjacent groups of the energy generating elements.

4. The liquid discharging head according to claim 1, wherein the sub-control circuit is configured to vary the balance of energy generation between the at least one pair of energy generating elements by selectively sending current to and drawing current from the connection midpoint between the at least one pair of energy generating elements thereby controlling an electric potential between the at least one pair of energy generating elements.

5. The liquid discharging head according to claim 1, wherein the selector includes a fourth contact and a fifth contact connectable to the connection midpoint between the at least one pair of energy generating elements by way of said switch, the fourth contact being connected to a resistor and the power supply and the fifth contact being connected to a resistor and ground, so that current flows from the sub-control circuit to the connection midpoint between the at least one pair of energy generating elements when the selector switch is connected to the fourth contact, current flows to the sub-control circuit from the connection midpoint between the at least one pair of energy generating elements when the selector switch is connected to the fifth contact during operation of the liquid discharging head, and wherein the resistor connected to the first contact has a resistance that is different than a resistance of the resistor connected to the first contact and the resistor connected to the third contact has a resistance that is different than a resistance of the resistor connected to the fifth contact.

6. The liquid discharging head according to claim 1, wherein each pair of energy generating elements of said at least one pair of energy generating elements is separated by a gap.

7. The liquid discharging head according to claim 1 further comprising at least two pairs of energy generating elements.

8. The liquid discharging head according to claim 7, wherein said at least two pairs of energy generating elements are arranged in a row.

9. The liquid discharging head according to claim 7, wherein said at least two pairs of energy generating elements are positioned in a radial pattern.

10. The liquid discharging head according to claim 9, wherein said sub-control circuit is connected to a connection midpoint between each pair of energy generating elements of the at least two pairs of energy generating elements.

11. The liquid discharging head according to claim 9, wherein all of the energy generating elements corresponding to a single liquid chamber are electrically connected in a center between the energy generating elements.

12. A liquid discharging apparatus having a liquid discharging head, the liquid discharging head comprising:

at least one liquid chamber holding liquid;

a nozzle provided for each liquid chamber;

at least one pair of energy generating elements provided for each liquid chamber, and applying energy to the liquid held in the liquid chamber to discharge the liquid from the nozzle;

a main control circuit connecting a series circuit of the at least one pair of energy generating elements to a power supply, and driving the at least one pair of energy generating elements according to the timing for discharging the liquid;

a sub-control circuit connected to a connection midpoint between the at least one pair of energy generating elements, and varying the balance of energy generation between the at least one pair of energy generating elements;

a first wiring pattern connecting the connection midpoint to the sub-control circuit; and second wiring patterns connecting the at least one pair of energy generating elements to the main control circuit, wherein, the first wiring pattern has a width narrower than the width of the second wiring pattern, and the sub-control circuit comprises a selector including a switch connected to the connection midpoint between the at least one pair of energy generating elements and selectively connectable to: (a) a first contact connected to a resistor and a power supply; (b) a second contact that is not connected to the power supply or to ground and (c) a third contact connected to a resistor and ground, so that current flows from the sub-control circuit to the connection midpoint between the at least one pair of energy generating elements when the selector switch is connected to the first contact of said three contacts, current does not flow between the sub-control circuit and the connection midpoint between the at least one pair of energy generating elements when the selector switch is connected to the second contact of the three contacts, and current flows to the sub-control circuit from the connection midpoint between the at least one pair of energy generating elements when the selector switch is connected to the third contact of said three contacts is selected during operation of the liquid discharging head.

13. A driving method for a liquid discharging head comprising a liquid chamber holding liquid; a nozzle provided for the liquid chamber; at least one pair of energy generating elements provided for the liquid chamber, and applying energy to the liquid held in the liquid chamber to discharge the liquid from the nozzle; a main control circuit connecting a series circuit of the at least one pair of energy generating elements to a power supply; a sub-control circuit connected to a connection midpoint between the at least one pair of energy generating elements; a first wiring pattern connecting the connection midpoint to the sub-control circuit; and second wiring patterns connecting the at least one pair of energy generating elements to the main control circuit, the driving method comprising the steps of:

driving the series circuit of the at least one pair of energy generating elements according to the timing for discharging the liquid by the main control circuit; and varying the balance of energy generation between the at least one pair of energy generating elements by the sub-control circuit, wherein, the first wiring pattern has a width narrower than the width of the second wiring pattern because the current necessary for the sub-control circuit is smaller than the current necessary for the main control circuit, and the sub-control circuit comprises a selector including a switch connected to the connection midpoint between the at least one pair of energy generating elements and selectively connectable to: (a) a first contact connected to a resistor and a power supply; (b) a second contact that is not connected to the power supply or to ground and (c) a third contact connected to a resistor and ground, so that current flows from the sub-control circuit to the connection midpoint between the at least one pair of energy generating elements when the selector switch is connected to the first contact of said three contacts, current does not flow between the sub-control circuit and the connection midpoint between the at least one pair of energy generating elements when the selector switch is connected to the second contact of the three contacts, and current flows to the sub-control circuit from the connection midpoint between the at least one pair of energy generating elements when the selector switch is connected to the third contact of said three contacts is selected during operation of the liquid discharging head.

14. A drive method according to claim 13 wherein said step of varying the balance of energy generation between the at least one pair of energy generating elements includes controlling an electrical potential between the at least one pair of energy generating elements by selectively sending current to the midpoint between the at least one pair of energy generating elements from the sub-control circuit, drawing current from the midpoint between the at least one pair of energy generating elements, and not sending current to or drawing current from the midpoint between the at least one pair of energy generating elements.

15. A drive method according to claim 13 wherein the liquid discharging head comprises at least two pair of energy generating elements corresponding to the liquid chamber and said varying step includes varying a balance of energy generated by the at least two pairs of energy generating elements to selectively discharge liquid from the head in one of at least four directions.

* * * * *